US010750825B2

(12) United States Patent
Uda et al.

(10) Patent No.: US 10,750,825 B2
(45) Date of Patent: Aug. 25, 2020

(54) SHOES

(71) Applicant: Mizuno Corporation, Osaka (JP)

(72) Inventors: Masashi Uda, Osaka (JP); Ken Nishikawa, Osaka (JP)

(73) Assignee: Mizuno Corporation, Osaka (JP)

( * ) Notice: Subject to any disclaimer, the term of this patent is extended or adjusted under 35 U.S.C. 154(b) by 65 days.

(21) Appl. No.: 16/059,592

(22) Filed: Aug. 9, 2018

(65) Prior Publication Data

US 2019/0045884 A1 Feb. 14, 2019

(30) Foreign Application Priority Data

Aug. 10, 2017 (JP) ..... 2017-155484

(51) Int. Cl.

| | |
|---|---|
| ***A43B 23/08*** | (2006.01) |
| ***A43B 21/32*** | (2006.01) |
| ***A43B 21/26*** | (2006.01) |
| ***A43B 13/37*** | (2006.01) |
| ***A43B 13/18*** | (2006.01) |
| ***A43B 13/04*** | (2006.01) |

(Continued)

(52) U.S. Cl.

CPC ..... *A43B 21/32* (2013.01); *A43B 7/16* (2013.01); *A43B 13/04* (2013.01); *A43B 13/187* (2013.01); *A43B 13/37* (2013.01); *A43B 21/26* (2013.01); *A43B 23/0205* (2013.01); *A43B 23/027* (2013.01); *A43B 23/0265* (2013.01); *A43B 23/088* (2013.01); *A43B 23/17* (2013.01)

(58) Field of Classification Search

CPC ..... A43B 7/16; A43B 7/20; A43B 23/088; A43B 23/17; A43B 21/32; A43B 13/04; A43B 13/18; A43B 13/37

See application file for complete search history.

(56) References Cited

U.S. PATENT DOCUMENTS 912,579 A * 2/1909 Bruns et al. ..... A43B 23/28 36/58.5
1,972,899 A * 9/1934 Odell ..... A43B 21/32 36/140

(Continued)

FOREIGN PATENT DOCUMENTS

DE 3629264 A1 3/1988
JP H02503271 A 10/1990

(Continued)

OTHER PUBLICATIONS

Japanese Office Action issued in related application No. JP2017-155484 dated Jun. 19, 2018.

*Primary Examiner* — Ted Kavanaugh

(74) *Attorney, Agent, or Firm* — Troutman Pepper Hamilton Sanders LLP; James E. Schutz; Micah B. Hensley

(57) ABSTRACT

A shoe includes: a sole made of an elastic material and including a planta support configured to support a plantar surface of a foot; an upper attached to the sole and configured to cover the foot; and a heel counter provided above the planta support, arranged in a heel area of the upper, and covering a region of the foot from a medial side portion to a lateral side portion. The heel counter includes, in a lower rear portion of the heel area, a notch (deformation allowance portion) which is configured to allow impact deformation caused by upward movement of a rear portion of the planta support when the sole receives impact.

7 Claims, 13 Drawing Sheets

(51) Int. Cl.

| | |
|---|---|
| ***A43B 23/02*** | (2006.01) |
| ***A43B 7/16*** | (2006.01) |
| ***A43B 23/17*** | (2006.01) |

(56) References Cited

U.S. PATENT DOCUMENTS

| | | | | | |
|---|---|---|---|---|---|
| 2,736,110 | A * | 2/1956 | Hardimon | A43B 11/00 | 36/58.5 |
| 4,821,430 | A * | 4/1989 | Flemming | A43B 23/17 | 36/68 |
| 5,152,082 | A * | 10/1992 | Culpepper | A43B 7/14 | 36/114 |
| 5,408,761 | A | 4/1995 | Gazzano | | |
| 6,000,148 | A * | 12/1999 | Cretinon | A43B 5/00 | 36/69 |
| 10,455,898 | B1 * | 10/2019 | Orand | A43B 23/26 | |
| 2003/0051372 | A1 * | 3/2003 | Lyden | A43B 1/0081 | 36/27 |
| 2007/0043630 | A1 * | 2/2007 | Lyden | A43B 1/0081 | 705/26.41 |
| 2010/0293811 | A1 | 11/2010 | Truelsen | | |
| 2011/0119959 | A1 * | 5/2011 | Bodner | A43B 7/32 | 36/91 |
| 2011/0185592 | A1 * | 8/2011 | Nishiwaki | A43B 7/16 | 36/69 |
| 2014/0305005 | A1 | 10/2014 | Yeh | | |
| 2016/0278472 | A1 * | 9/2016 | Poshedley, III | A43B 3/166 | |

FOREIGN PATENT DOCUMENTS

| | | | |
|---|---|---|---|
| JP | 2008206629 | A | 9/2008 |
| KR | 19950003250 | | 4/1995 |
| TW | M458848 | | 4/2013 |
| WO | 8808678 | A1 | 11/1988 |
| WO | 2010038267 | A1 | 4/2010 |

* cited by examiner

SHOES

CROSS-REFERENCE TO RELATED APPLICATION

This application claims priority to Japanese Patent Application No. 2017-155484 filed on Aug. 10, 2017, the entire disclosure of which is incorporated by reference herein.

BACKGROUND

The present disclosure relates to a shoe.

As disclosed in, for example, Japanese Unexamined Patent Publication No. 2008-206629 (JP 2008-206629 A1), shoes including a heel counter configured to cover the heel of a foot of a wearer have been known. Specifically, the shoe of JP 2008-206629 A1 includes: a sole made of an elastic material and including a planta support configured to support the plantar surface of a foot of a wearer; an upper attached to the sole and configured to cover the wearer's foot; and the heel counter arranged on top of the planta support and corresponding to the heel of the wearer's foot.

SUMMARY

In general, at a moment when a person wearing sport shoes (hereinafter referred to as the "wearer") steps on the ground or a floor (hereinafter referred to as the "moment of touching the ground") during, for example, a sports game, the sole made of an elastic material is compressively deformed. Due to this compressive deformability of the sole, the shoes as a whole have cushioning properties.

However, in the shoes of JP 2008-206629 A1, the heel counter that is more rigid than the sole is arranged directly above the planta support in a rear portion of the sole. Therefore, when the wearer steps on the ground such that the heel of the shoe first touches the ground, although the sole is compressively deformed in a portion between the ground surface and the heel counter, the shoe may exhibit the cushioning properties insufficiently. That is, in the shoes of JP 2008-206629 A1, the heel counter makes it difficult for the sole to exhibit the cushioning properties to a sufficient extent.

In addition, the heel counter, which is arranged directly above the planta support in the rear portion of the sole, is likely to be moved upward by being pushed upward by a repulsive force which is generated due to the compressive deformation of the sole caused at the moment of touching the ground. As a result, since the top end of the heel counter of the shoes of JP 2008-206629 A1 upwardly rubs against a rear side of the ankle of a wearer (a region near his/her Achilles tendon), the wearer feels physical unease such as a blister at the rear side of his/her ankle at the moment of touching the ground.

Moreover, in the shoes of JP 2008-206629 A1, at the moment of touching the ground, since the heel counter is moved upward while the cushioning properties of the sole are exhibited insufficiently, the heel counter no longer fits the wearer's heel. As a result, the shoes cause the wearer's ankle to be unsteady at the moment of touching the ground and give the wearer a sense of insufficient stability when he/she steps on the ground.

In view of the foregoing problems, it is therefore an object of the present disclosure to achieve further enhancement of the cushioning properties of a sole and to give a wearer a sense of stability when he/she steps on the ground.

To achieve the above object, a first aspect of the present disclosure is directed a shoe. The shoe includes: a sole made of an elastic material and including a planta support configured to support a plantar surface of a foot of a wearer; an upper attached to the sole and configured to cover the foot of the wearer; and a heel counter provided above the planta support, arranged in a heel area of the upper corresponding to a heel of the foot, and extending from a medial side portion to a lateral side portion of the foot so as to cover the heel, wherein the heel counter includes, in a lower rear portion of the heel area, a deformation allowance portion which is configured to allow impact deformation caused by upward movement of a rear portion of the planta support when the sole receives impact.

According to the first aspect, when the wearer steps on the ground or a floor (at the moment of touching the ground), the deformation allowance portion of the heel counter allows the sole to be compressively deformed in the heel area and bent toward the deformation allowance portion (i.e., bent upward relative to the planta support), thereby enhancing the cushioning properties of the sole. Furthermore, the deformation allowance portion hinders the repulsive force, which is generated by the compressive deformation of the sole at the moment of touching the ground, from pushing the heel counter upward. Consequently, the heel counter is substantially prevented from being moved upward immediately after the wearer steps on the ground. As a result, the heel counter is hindered from rubbing upward against the rear side of the ankle of the wearer (a region near his/her Achilles tendon) at the moment of touching the ground. This makes it possible to substantially prevent the wearer from feeling physical unease such as a blister at the rear side of his/her ankle. Moreover, the deformation allowance portion enhances the cushioning properties of the sole at the time of touching the ground, and substantially prevents the heel counter from being moved upward immediately after the moment of touching the ground, thereby keeping the heel counter fitting the wearer's heel at the moment of touching the ground. As a result, the wearer's ankle is stabilized substantially without being unsteady at the moment of touching the ground. Thus, the shoe of the first aspect is capable of further enhancing the cushioning properties of the sole and giving the wearer a sense of stability when he/she steps on the ground.

A second aspect of the present disclosure is an embodiment of the first aspect. In the second aspect, the deformation allowance portion has a top end located between a lower end of a calcaneus of the foot and a top end of a calcaneal tuber.

According to the second aspect, the deformation allowance portion is designed to have a size such that the heel counter is substantially prevented from upwardly rubbing against the rear side of the ankle of the wearer (a region near his/her Achilles tendon) when the wearer steps on the ground. This makes it possible to substantially prevent the wearer from feeling physical unease at the rear side of his/her heel when he/she steps on the ground, while sufficiently protecting the rear side of his/her heel with the heel counter.

A third aspect of the present disclosure is an embodiment of the first aspect. In the third aspect, the deformation allowance portion is comprised of a notch formed in a lower rear portion of the heel counter and having a shape of a recess which is concave upward.

The simple structure of the third aspect enables a portion of, the heel counter, corresponding to the lower rear portion of the heel area to function as the deformation allowance portion.

A fourth aspect of the present disclosure is an embodiment of the first aspect. In the fourth aspect, the deformation allowance portion is configured to be more deformable than the heel counter, or made of a material which is deformable than the heel counter.

The fourth aspect can provide the same effect as those of the first aspect, while softly protecting the lower rear portion of the heel area with the deformation allowance portion that is configured to be more deformable than the heel counter or made of a material more deformable than the heel counter.

A fifth aspect of the present disclosure is an embodiment of the first aspect. In the fifth aspect, the deformation allowance portion is shaped such that an area of the deformation allowance portion adjacent to the lateral side is asymmetric in size to an area of the deformation allowance portion adjacent to the medial side.

In the fifth aspect, impact applied predominantly to one of a region of the heel adjacent to the lateral side or a region of the heel adjacent to the medial side when the wearer steps on the ground can be preferentially reduced in accordance with the styles of various sports games.

A sixth aspect of the present disclosure is an embodiment of the fifth aspect. In the sixth aspect, the deformation allowance portion is shaped such that the area adjacent to the lateral side is larger than the area adjacent to the medial side.

According to the sixth aspect, the deformation allowance portion preferentially reduces impact which is predominantly applied to a lateral side region of the heel when the wearer steps on the ground during waking, running, or a sport. As a result, the wearer is allowed to step the ground with the lateral side region of his/her foot in a stable manner in an initial stage of a shift of the wearer's body weight (a so-called load path).

The seventh aspect of the present disclosure is an embodiment of the first aspect. In the seventh aspect, a reinforcing plate which is comprised of a thin layer harder than the sole is provided in an intermediate portion of the sole in a thickness direction.

According to the seventh aspect, the reinforcing plate disperses impact applied locally to a foot at the moment of touching the ground, enabling reduction of local impact applied to the foot. Consequently, in conjunction with the effect provided by the deformation allowance portion of the heel counter, the reinforcing plate can give the wearer a sense of increased stability when he/she steps on the ground.

An eighth aspect of the present disclosure is an embodiment of the first aspect. According to the eighth aspect, the sole includes an outer cover portion which externally covers a rear portion of the upper, and the outer cover portion has a top end located above a top end of the deformation allowance portion.

In the eighth aspect, the outer cover portion suitably covers wrinkles which are easily formed in the rear portion of the upper at the moment of touching the ground. This substantially prevents the esthetic quality of the shoe from being deteriorated.

A ninth aspect of the present disclosure is an embodiment of the first aspect. In the ninth aspect, the heel counter is covered with the upper.

According to the ninth aspect, since the heel counter is covered with the upper, the heel counter is protected inside the shoe. This can substantially prevent, in particular, the heel area of the shoe from being damaged.

As can be seen from the foregoing description, the present disclosure can give a wearer a sense of stability when he/she steps on the ground, while maintaining the cushioning properties of a sole.

DETAILED DESCRIPTION

Embodiments of the present disclosure will now be described in detail with reference to the drawings. Note that the following description of the embodiments is merely an example in nature, and is not intended to limit the scope, application, or uses of the present disclosure.

Figure 1:
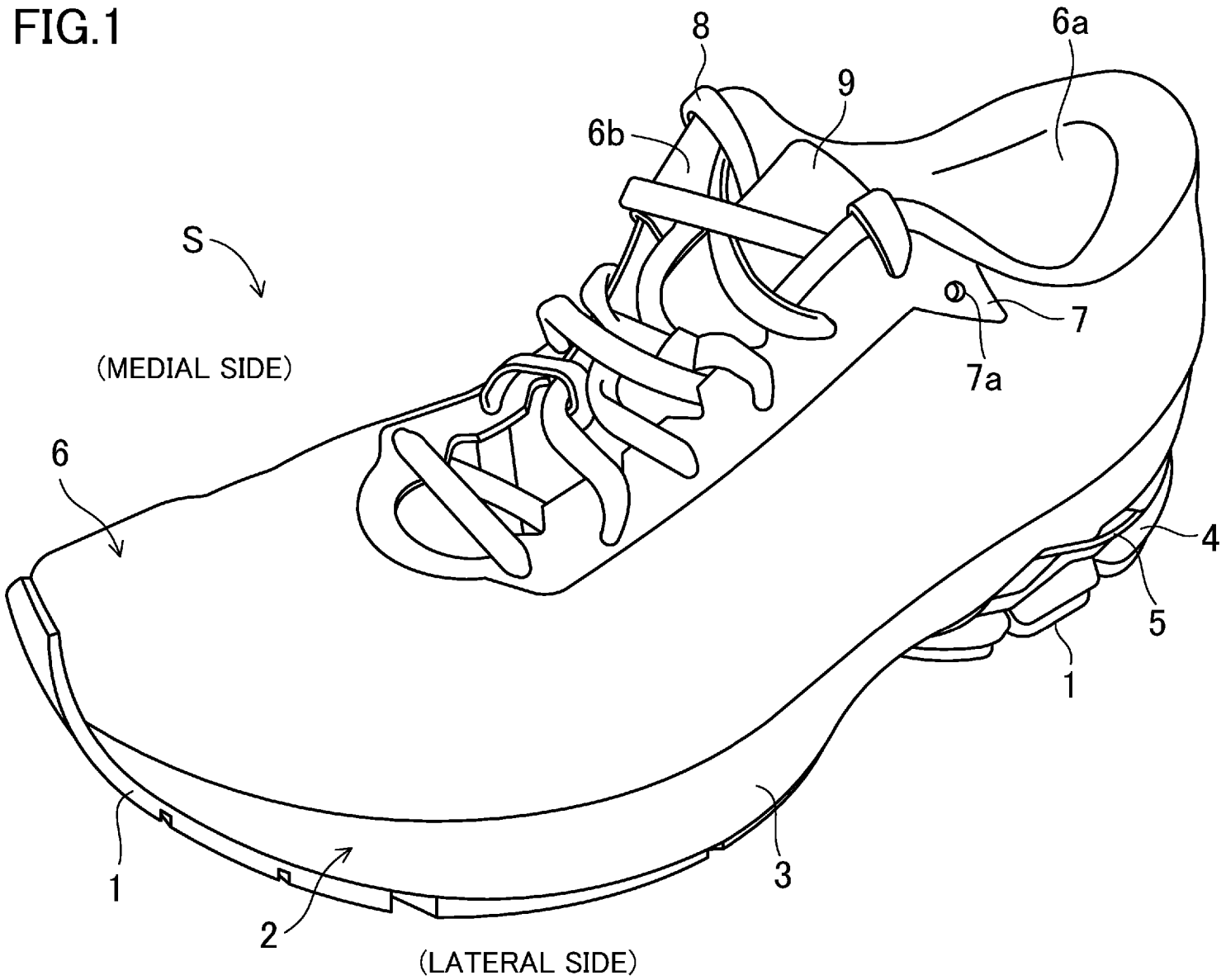
FIG. 1 is a perspective view of a shoe according to an embodiment of the present disclosure.
Figure 2:
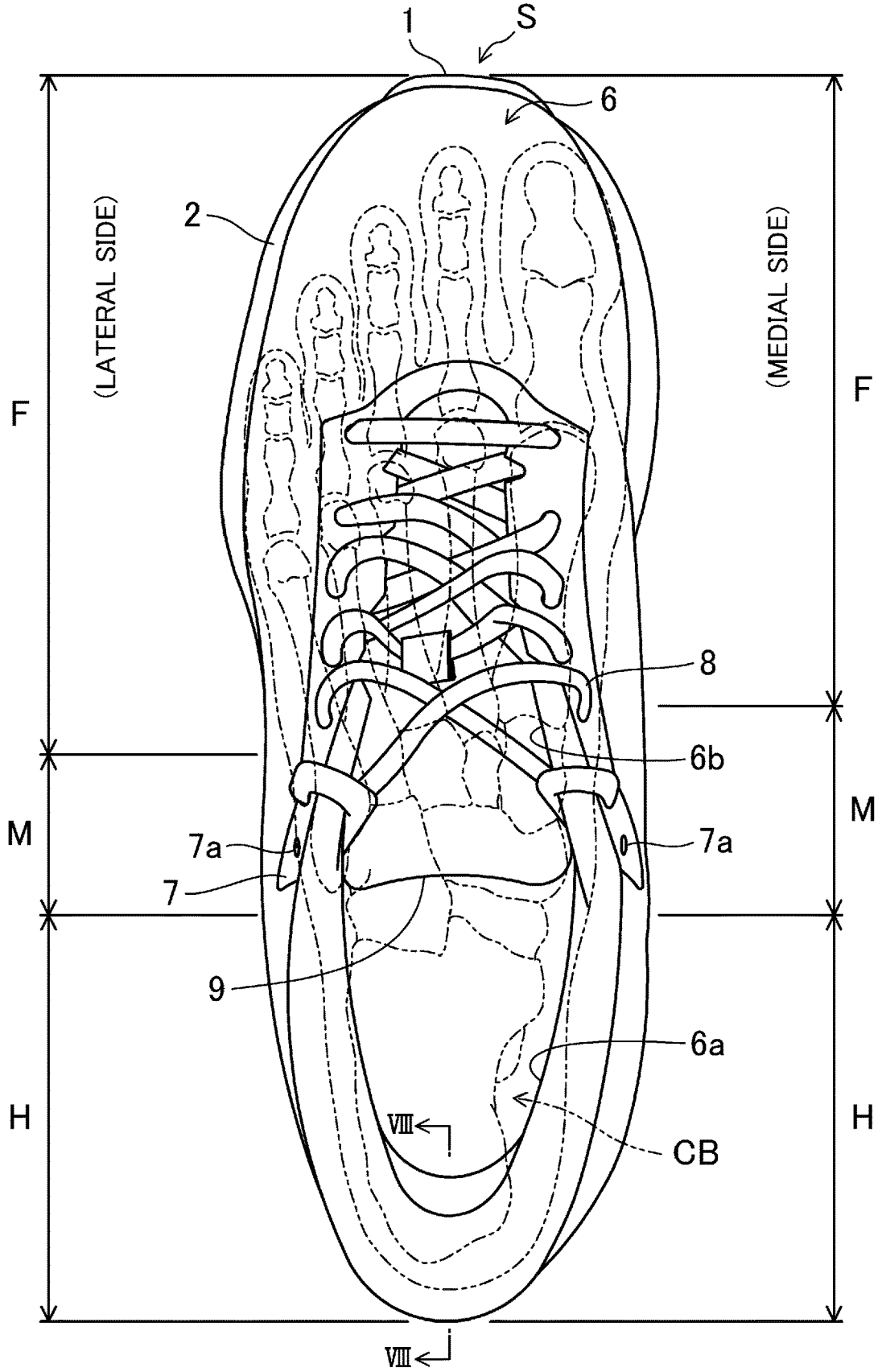
FIG. 2 is a plan view showing the shoe according to the embodiment of the present disclosure, together with the skeletal structure of a foot.
Figure 3:
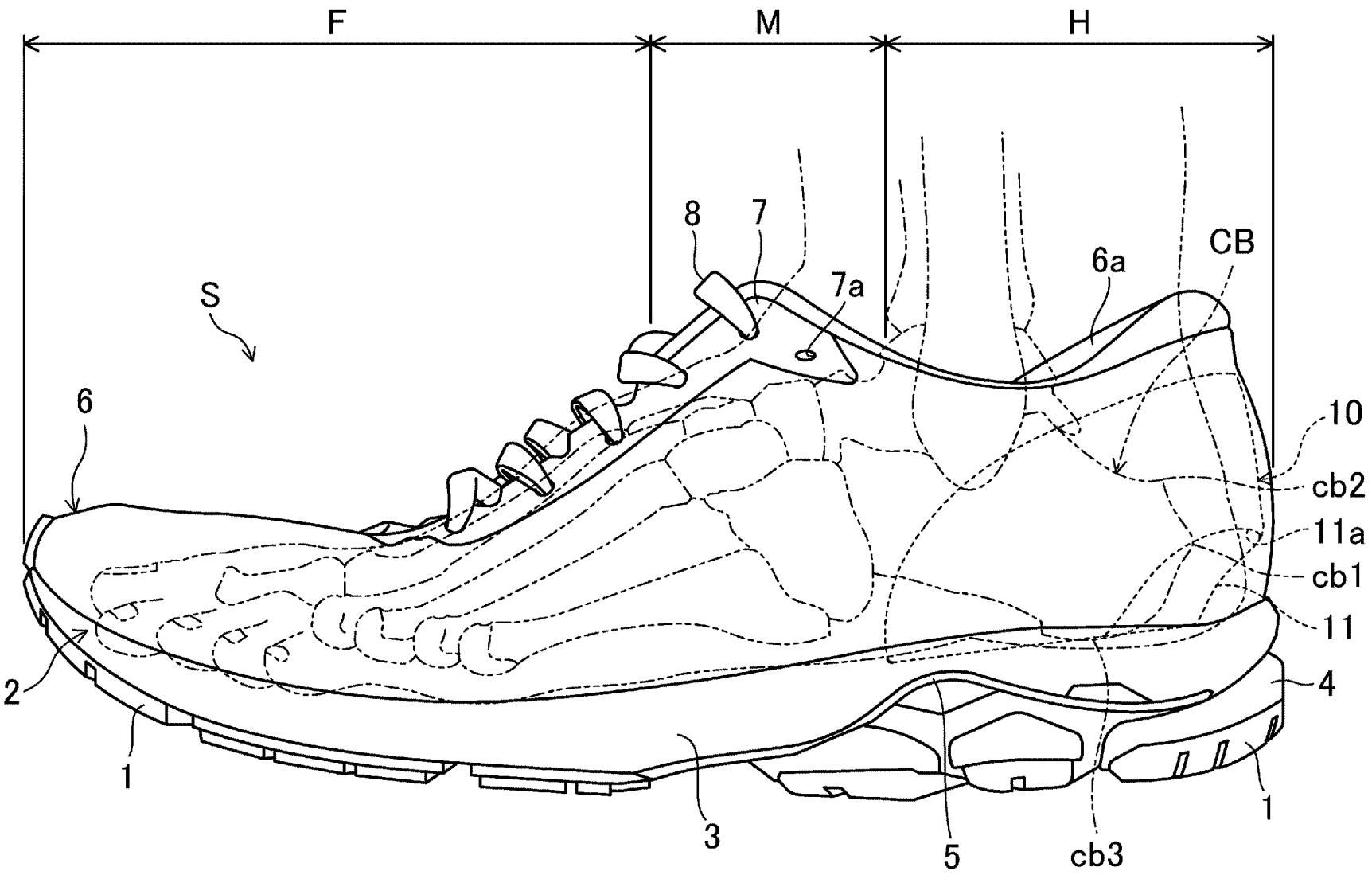
FIG. 3 is a side view, as viewed from a lateral side, showing the shoe according to the embodiment of the present disclosure, together with the skeletal structure of a foot.

FIGS. 1 to 3 show the overall structure of a shoe S according to an embodiment of the present disclosure. A pair of shoes S may be used, for example, as athletic shoes for running and various sports such as badminton, sneakers for daily use, and rehabilitation shoes.

The drawings illustrate a left shoe S only as an example. Since the right shoe is symmetrical to the left shoe, only the left shoe will be described in the following description, and the description of the right shoe will be omitted herein.

In the following description, the expressions "above," "upward," "on a/the top of," "below," "under," and "downward," represent the vertical positional relationship between respective components of the shoe S. The expressions "front," "fore," "forward," "anterior," "rear," "hind," "behind," "backward," and "posterior" represent the positional relationship in the longitudinal direction between respective components of the shoe S. The expressions "medial side" and "lateral side" represent the positional relationship in the foot width direction between respective components of the shoe S.

As shown in FIGS. 1 to 3, the shoe S includes a sole made of an elastic material. The sole includes an outsole 1 extending over a region from the forefoot F to the hindfoot H of a foot of a person wearing the shoe S (hereinafter referred to as the "wearer"). The outsole 1 is made of a hard elastic material which is harder than the material for a midsole 2, which will be described later. Examples of suitable materials for the outsole 1 include, but are not limited to, thermoplastic resins such as ethylene-vinyl acetate copolymer (EVA), thermosetting resins such as polyurethane (PU), and rubber materials such as butadiene rubber and chloroprene rubber. The outsole 1 has, on its lower surface, a ground surface configured to touch the ground or a floor.

Figure 8:
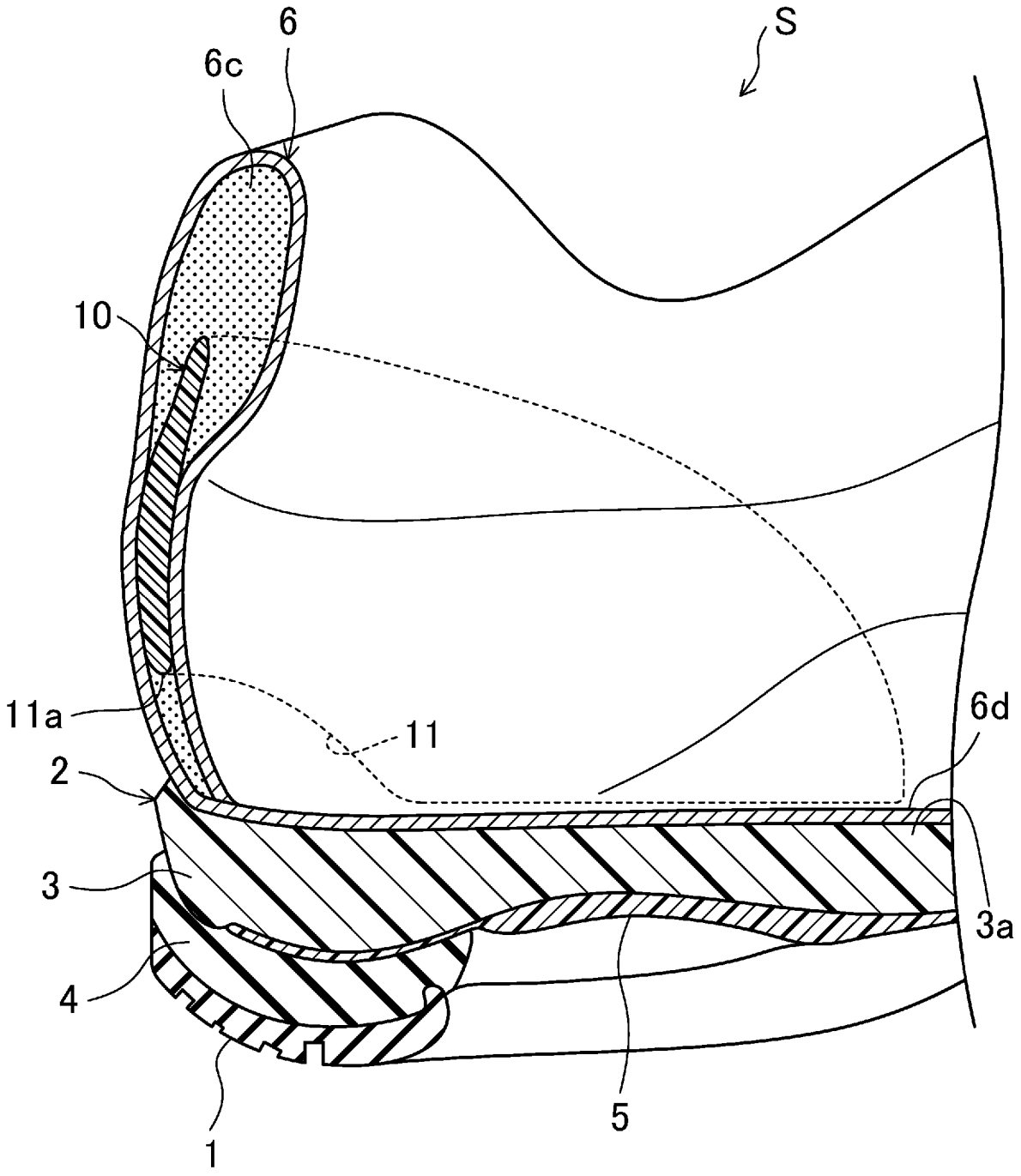
FIG. 8 is a cross-sectional view taken along line VIII-VIII in FIG. 2.

The sole further includes the midsole 2 which supports a region, of the wearer's plantar surface, extending from the forefoot F to the hindfoot H. The midsole 2 is made of a soft elastic material. Examples of suitable materials for the midsole 2 include, but are not limited to, thermoplastic synthetic resins such as ethylene-vinyl acetate copolymer (EVA) and foams of the thermoplastic synthetic resins, thermosetting resins such as polyurethane (PU) and foams of the thermosetting resins, and rubber materials such as butadiene rubber and chloroprene rubber and foams of the rubber materials. The midsole 2 is stacked on top of the outsole 1, while having a lower portion thereof bonded to a top portion of the outsole 1 with an adhesive or other means. The midsole 2 is divided into portions arranged in the vertical direction. Specifically, as shown in FIG. 8, the midsole 2 includes an upper midsole 3 and a lower midsole 4 stacked below the upper midsole 3. The upper midsole 3 has, on its upper portion, a planta support 3*a* which is configured to support the plantar surface of a foot of a wearer.

A reinforcing plate 5 is disposed between the upper and lower midsoles 3 and 4 so as to correspond to the hindfoot H of the foot. The reinforcing plate 5 is comprised of a thin layer which is harder than the upper and lower midsoles 3 and 4, and has a corrugated shape having peaks and valleys alternating with each other in the longitudinal direction. Note that the reinforcing plate 5 is not limited to the corrugated shape, and may have a flat shape, for example.

An upper 6 configured to cover the wearer's foot is provided on the periphery of the upper midsole 3. The upper 6 is configured to cover the wearer's foot, from the tiptoe of the forefoot F to the rear side of the heel of the hindfoot H. The upper 6 has a lower portion coupled to an upper portion of the midsole 2. Specifically, the periphery of the lower portion of the upper 6 is integrally fixed to the entire periphery of the upper midsole 3 with an adhesive or the like.

The upper 6 is made of a stretchable material. Specifically, examples of suitable materials for the upper 6 include, but are not limited to, knitted fabric, woven fabric, unwoven fabric, synthetic leather, and natural leather. For example, the upper 6 is suitably made of a mesh fabric having meshes and produced by warp-knitting (i.e., double-raschel knitting) a polyester yarn.

The upper 6 has, in its top portion, an ankle opening 6*a* through which the wearer inserts his/her foot, and a throat opening 6*b* which is continuous with the ankle opening 6*a* and extends in the longitudinal direction. In the top portion of the upper 6, an eyelet trimming part 7 is fixed along the throat opening 6*b* by, for example, sewing. The eyelet trimming part 7 has, in its left and right edge portions, eyelet holes 7*a*, 7*a*, . . . which are arranged at intervals in the longitudinal direction and penetrate the eyelet trimming part 7. A shoe lace 8 is passed through the eyelet holes 7*a*. A tongue 9 is attached to a front edge of the throat opening 6*b* to open and close the throat opening 6*b*. Further, a cushioning material 6*c* is embedded inside an upper rear portion of the upper 6. Moreover, as shown in FIG. 8, an intermediate sole 6*d* made of a material similar to that of the upper 6 is provided on top of the planta support 3*a* of the upper midsole 3.

As shown in FIGS. 3 to 8, the shoe S includes a heel counter 10 configured to protect the heel of the wearer's foot. Examples of the material for the heel counter 10 include, but are not limited to: thermoplastic resins such as thermoplastic polyurethane (TPU), polyamide elastomer (PAE), ABS resin, and ethylene-vinyl acetate copolymer (EVA); thermosetting resins such as epoxy resin and unsaturated polyester resin; thermoplastic rubber (TRP); natural leather; and synthetic leather. The heel counter 10 is produced by, for example, injection molding.

Figure 7:
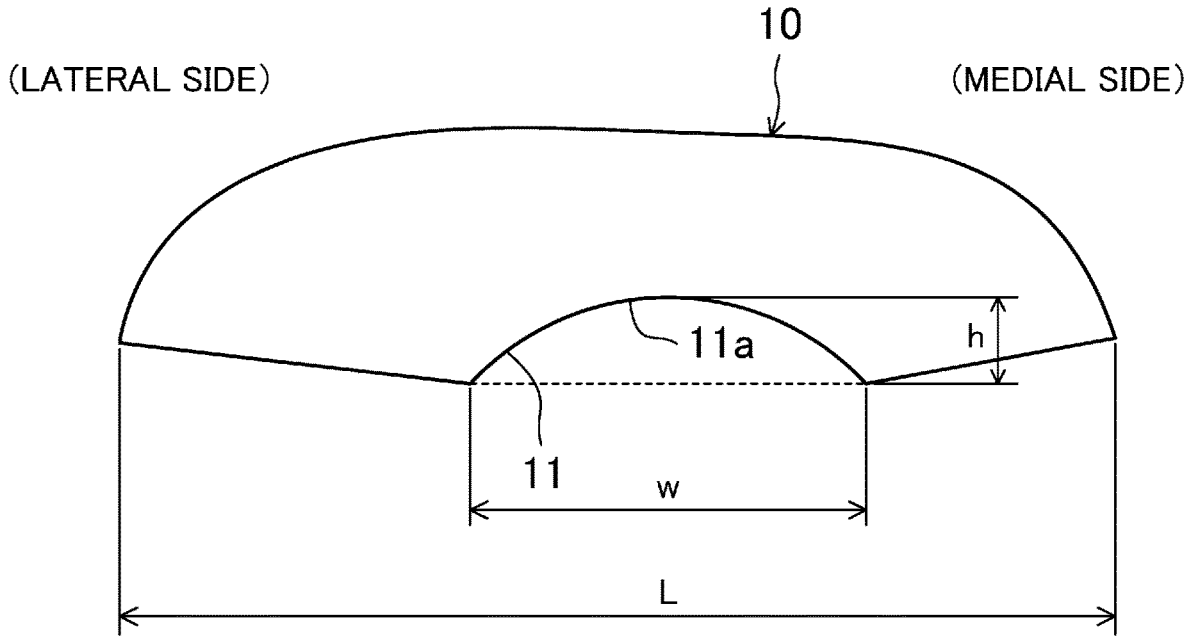
FIG. 7 is a developed view showing the structure of the heel counter.

The heel counter 10 is arranged above the planta support 3*a* and in a rear portion of the upper 6. Specifically, the heel counter 10 is arranged in a heel area H of the upper 6 corresponding to the heel of the foot (i.e., an area corresponding to the hindfoot H), and extends from a medial side portion to a lateral side portion through the rear side of the heel so as to cover the heel of the foot. As shown in FIG. 7, a length of the bottom edge of the heel counter 10 corresponds to a peripheral length L of the heel counter 10, and the peripheral length L ranges from 100 mm to 250 mm.

The present disclosure is characterized in that the heel counter 10 includes a deformation allowance portion arranged to correspond to a lower rear portion of the heel area H. The deformation allowance portion is configured to allow impact deformation caused by upward movement of a rear portion of the planta support 3*a* when the sole (the outsole 1 and the midsole 2) receives impact.

Figure 4:
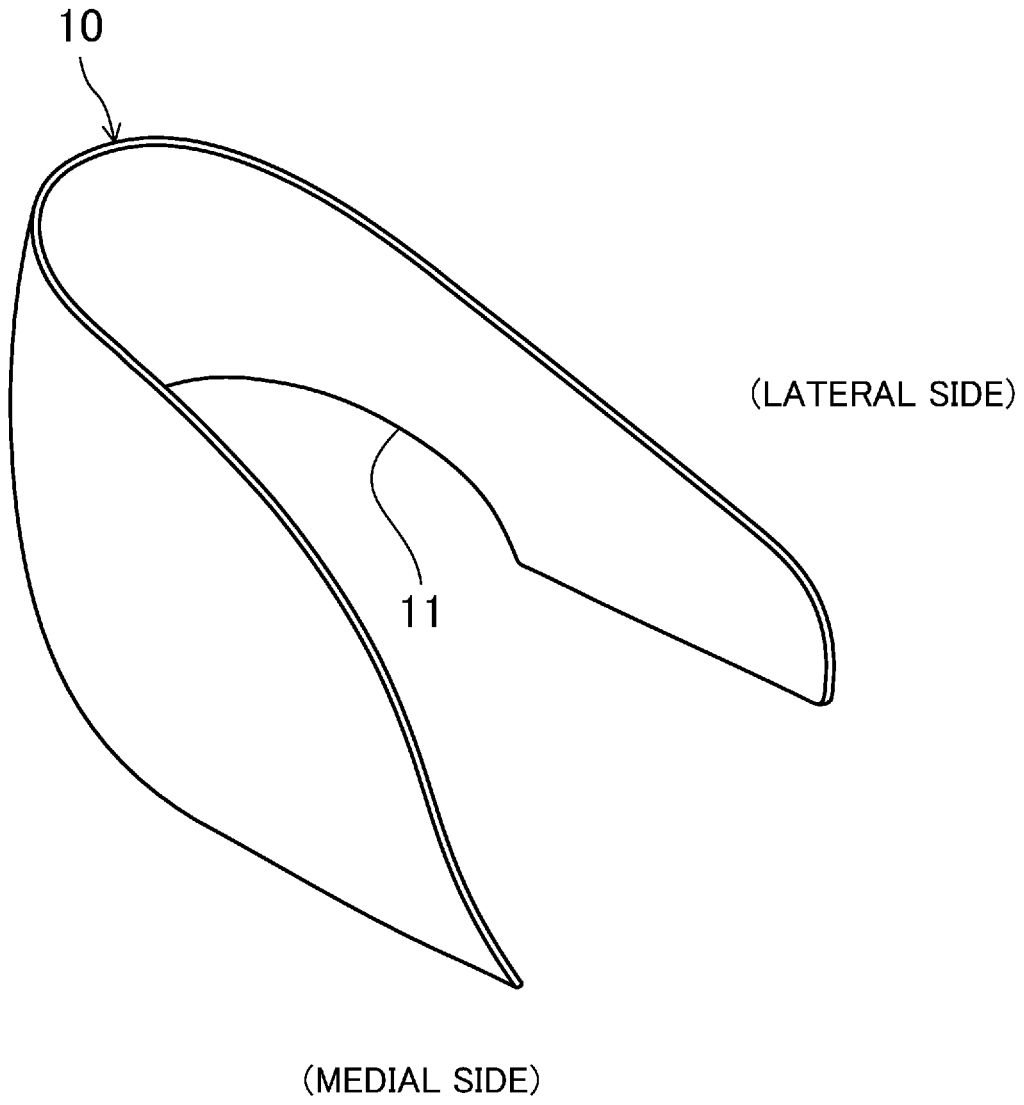
FIG. 4 is a perspective view showing the structure of a heel counter.
Figure 5:
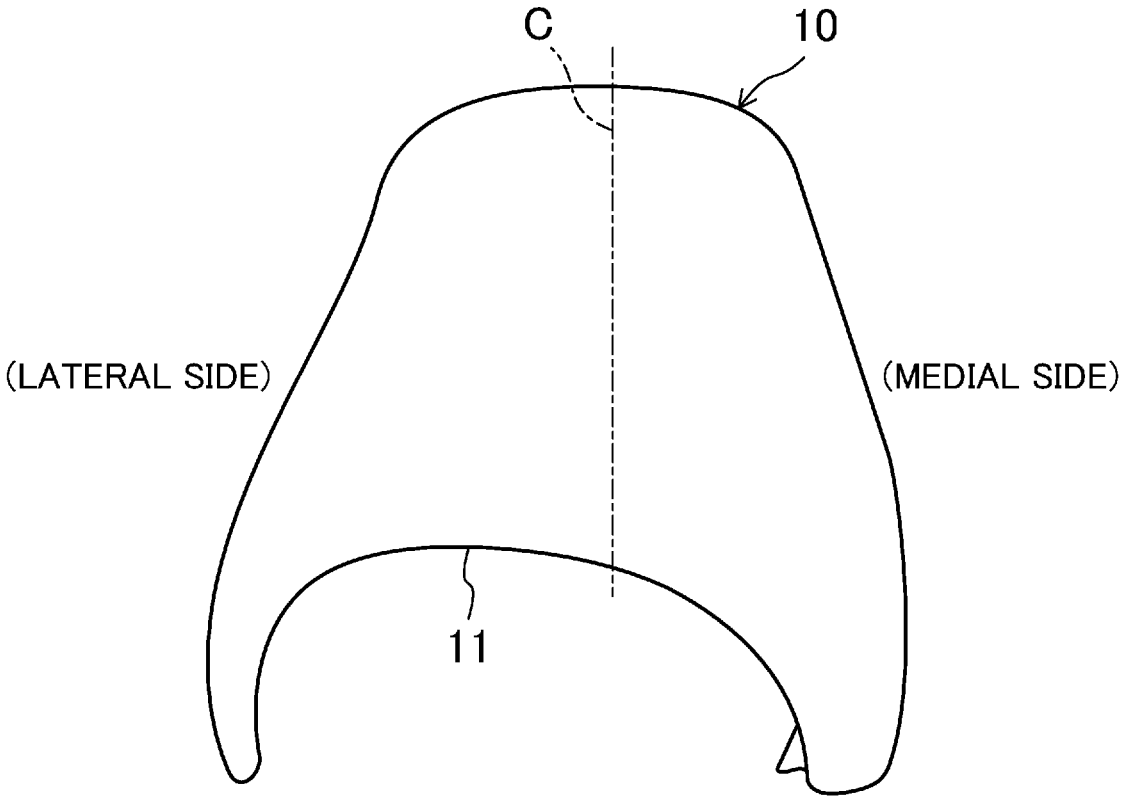
FIG. 5 is a back view showing the structure of the heel counter.
Figure 6:
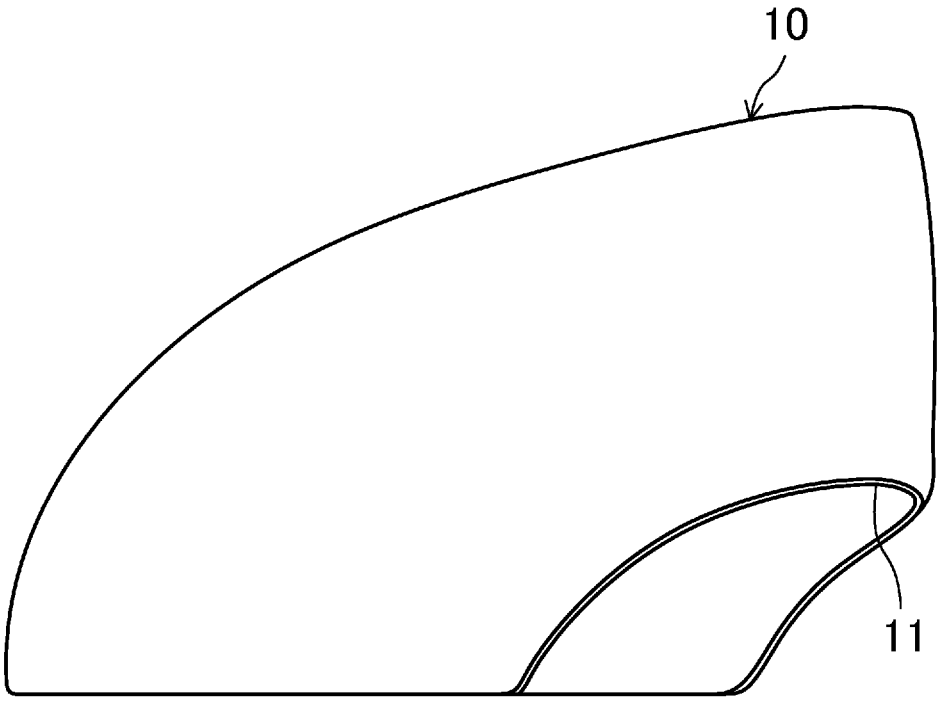
FIG. 6 is a side view showing the structure of the heel counter, as viewed from a lateral side.

In this embodiment, the deformation allowance portion is comprised of a notch 11, as shown in FIGS. 3 to 8. Specifically, as shown in FIG. 5, the notch 11 is formed in a lower rear portion of the heel counter 10 and has a shape of rounded recess which is concave upward in back view. As shown in FIG. 6, the notch 11 is defined by a substantially inclined edge which extends forward from a rear end of the heel counter 10 to a lower portion of the heel counter 10, as viewed from side.

In general, the calcaneus CB of a foot of a human body has, in its rear end region, a protrusion cb1 which protrudes rearward from a substantially center in the vertical direction, a top end cb2 located above the protrusion cb1, and a lower end cb3 located below the protrusion cb1 (see FIG. 3). The notch 11 is formed with this structure of the human foot taken into account. If a top end 11*a* of the notch 11 is located below the lower end cb3 of the rear end region of the calcaneus CB, the structural difference between the heel counter 10 and the known heel counter is difficult to notice. On the other hand, if the top end 11*a* of the notch 11 is located above the top end cb2 of the rear end region of the calcaneus CB, the rear side of the heel of the wearer may not be protected sufficiently by the heel counter 10. In view of these facts, the notch 11 is preferably formed such that its top end 11*a* is positioned between the lower end cb3 and the top end cb2 of the calcaneus CB. In particular, forming the top end 11*a* of the notch 11 such that the protrusion cb1 of the rear end region of the calcaneus CB is included in the area of the notch 11 makes it possible to protect the rear side of the heel of the wearer's foot with the heel counter 10 and to obtain effects of the deformation allowance portion (i.e., the notch 11), which will be descried later, to a sufficient extent.

Further, as shown in FIGS. 4 to 6, the notch 11 is shaped such that its area adjacent to the lateral side and its area adjacent to the medial side are asymmetric in size to each other. Specifically, the notch 11 is shaped such that the area adjacent to the lateral side (the area on the left of the dot-dash line C in FIG. 5) is larger than the area adjacent to the medial side (the area on the right of the dot-dash line C in FIG. 5).

It is preferable that the notch 11 be in the following size when it is developed. Referring to FIG. 7, the notch 11 has a height h ranging from 5 mm to 30 mm. The height h is the distance from bottom ends (indicated by the broken line in FIG. 7) to the top end 11*a* of the notch 11. In particular, taking into account the distance from the lower end cb3 to the protrusion cb1 of the rear end region of the calcaneus CB of the wearer's foot, the height h is preferably 10 mm or more. The notch 11 has a length W ranging from 10 mm to 125 mm. The length w corresponds to the distance between the bottom ends of the notch 11. If the length W were longer than 125 mm (for example, if the length W were 130 mm), the heel counter 10 would less firmly hold the heel of the foot in the foot width direction. In this embodiment, it is preferable that the dimensions of the heel counter 10 and the notch 11 be in the relationship described as $h \leq w/2 \leq L/3$.

Effects of Embodiment

In the shoe S of the embodiment of the present disclosure, when the wearer steps on the ground (i.e., at the moment of touching the ground) during, for example, a sports game, the sole (in particular, the midsole 2) made of an elastic material is compressively deformed. Due to this compressive deformability of the sole, the shoe S as a whole has cushioning properties.

Further, in the shoe S of the embodiment of the present disclosure, when the wearer steps on the ground (at the moment of touching the ground), the deformation allowance portion (the notch 11) of the heel counter 10 allows the sole to be compressively deformed in the heel area H and to be bent toward the notch 11 (i.e., to be bent upward relative to the planta support), thereby enhancing the cushioning properties of the sole. Furthermore, the deformation allowance portion hinders the repulsive force, which is generated at the moment of touching the ground by the compressive deformation of the sole, from pushing the heel counter 10 upward. Consequently, the heel counter 10 is substantially prevented from being moved upward immediately after the wearer steps on the ground. As a result, the heel counter 10 is hindered from rubbing upward against the rear side of the ankle of the wearer (a region near his/her Achilles tendon) at the moment of touching the ground. This makes it possible to substantially prevent the wearer from feeling physical unease such as a blister at the rear side of his/her ankle. Moreover, the deformation allowance portion enhances the cushioning properties of the sole at the time of touching the ground and substantially prevents the heel counter 10 from being moved upward immediately after the moment of touching the ground, thereby keeping the heel counter 10 fitting the wearer's heel at the moment of touching the ground. As a result, the wearer's ankle is stabilized substantially without being unsteady at the moment of touching the ground. Thus, the shoe S according to the embodiment of the present disclosure is capable of further enhancing the cushioning properties of the sole and giving the wearer a sense of stability when he/she steps on the ground.

The deformation allowance portion is formed such that its top end (the top end 11*a* of the notch 11) is positioned between the lower end cb3 of the calcaneus CB of a foot and the top end cb2 of the calcaneal tuber (the protrusion cb1 of the calcaneus CB). That is, the deformation allowance portion is designed to have a size such that the heel counter 10 is substantially prevented from upwardly rubbing against the rear side of the ankle of the wearer (a region near his/her Achilles tendon) at the moment when the wearer steps on the ground. This makes it possible to substantially prevent the wearer from feeling physical unease at the rear side of his/her heel when he/she steps on the ground, while sufficiently protecting the rear side of his/her heel with the heel counter 10.

The deformation allowance portion is comprised of the notch 11 formed in a lower rear portion of the heel counter 10 and having the shape of a recess which is concave upward. Thus, this simple structure enables a portion of, the heel counter 10, corresponding to the lower rear portion of the heel area H to function as the deformation allowance portion.

Further, the deformation allowance portion is shaped such that its area adjacent to the lateral side and its area adjacent to the medial side are asymmetric in size to each other. As a result, impact applied predominantly to one of a region of the heel adjacent to the lateral side or a region of the heel adjacent to the medial side when the wearer steps on the ground can be preferentially reduced in accordance with the styles of various sports games.

Further, the deformation allowance portion is shaped such that its area adjacent to the lateral side is larger than its area adjacent to the medial side. In general, when a shoe touches the ground or a floor while the wearer is walking, running, or playing a sport, a so-called load path, which represents the shift of the wearer's body weight, occurs in the wearer's foot. The load path starts from a lateral side portion of a hindfoot H of the foot (heel area H), passes through a central region of the heel area H in the foot width direction, a central portion of a midfoot M, and a medial side portion of a forefoot F, and reaches the tiptoes. The specific shape described above of the deformation allowance portion preferentially reduces impact which is predominantly applied to a lateral side region of the foot when the wearer steps on the ground during waking, running, or a sport. As a result, the wearer is allowed to step the ground with the lateral side region of his/her foot in a stable manner in an initial state of the load path.

Further, the reinforcing plate 5 that is comprised of a thin layer harder than the sole (midsole 2) is provided in an intermediate portion of the sole in a thickness direction. The reinforcing plate 5 disperses impact applied locally to the foot at the moment of touching the ground, enabling reduction of local impact applied to the foot. As a result, in conjunction with the effect provided by the deformation allowance portion of the heel counter 10, the reinforcing plate 5 can give the wearer a sense of increased stability when he/she steps on the ground.

Since the heel counter 10 is covered with the upper 6, the heel counter 10 is protected inside the shoe S. This can substantially prevent in particular, the heel area H of the shoe from being damaged.

First Variation of Embodiment

Figure 9:
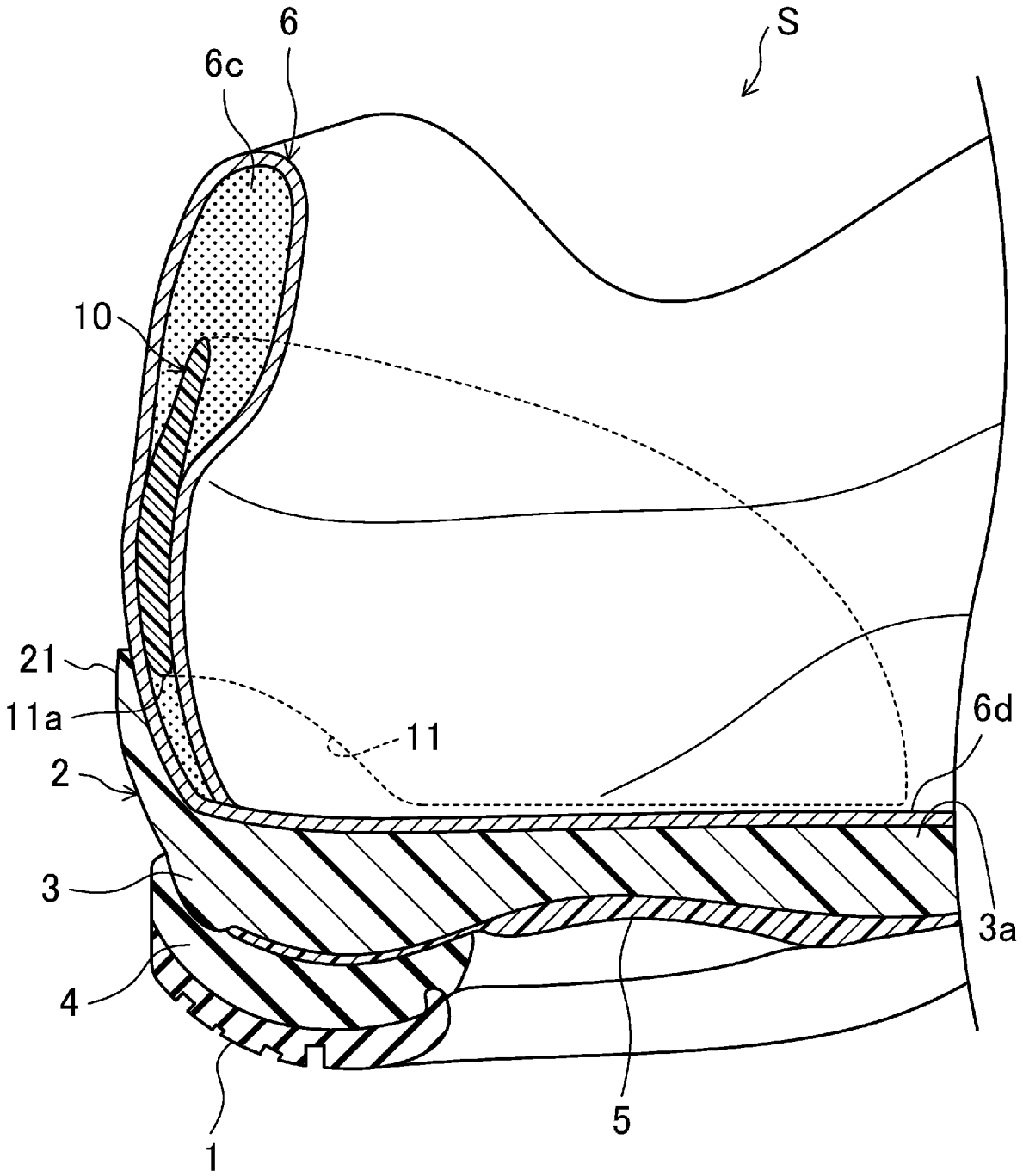
FIG. 9 corresponds to FIG. 8, and shows a shoe according to a first variation.

FIG. 9 shows a first variation of the shoe S according to the embodiment described above. As shown, the upper midsole 3 of the shoe S may include an outer cover portion 21 which externally covers a rear portion of the upper 6 and is more deformable than the heel counter 10. Specifically, the outer cover portion 21 has its top end located above the top end of the deformation allowance portion (i.e., the top end 11*a* of the notch 11). In this variation, the outer cover portion 21 suitably covers wrinkles which are easily formed in the rear portion of the upper 6 at the moment of touching the ground. This substantially prevents the aesthetic quality of the shoe S from being deteriorated.

Second Variation of Embodiment

Figure 10:
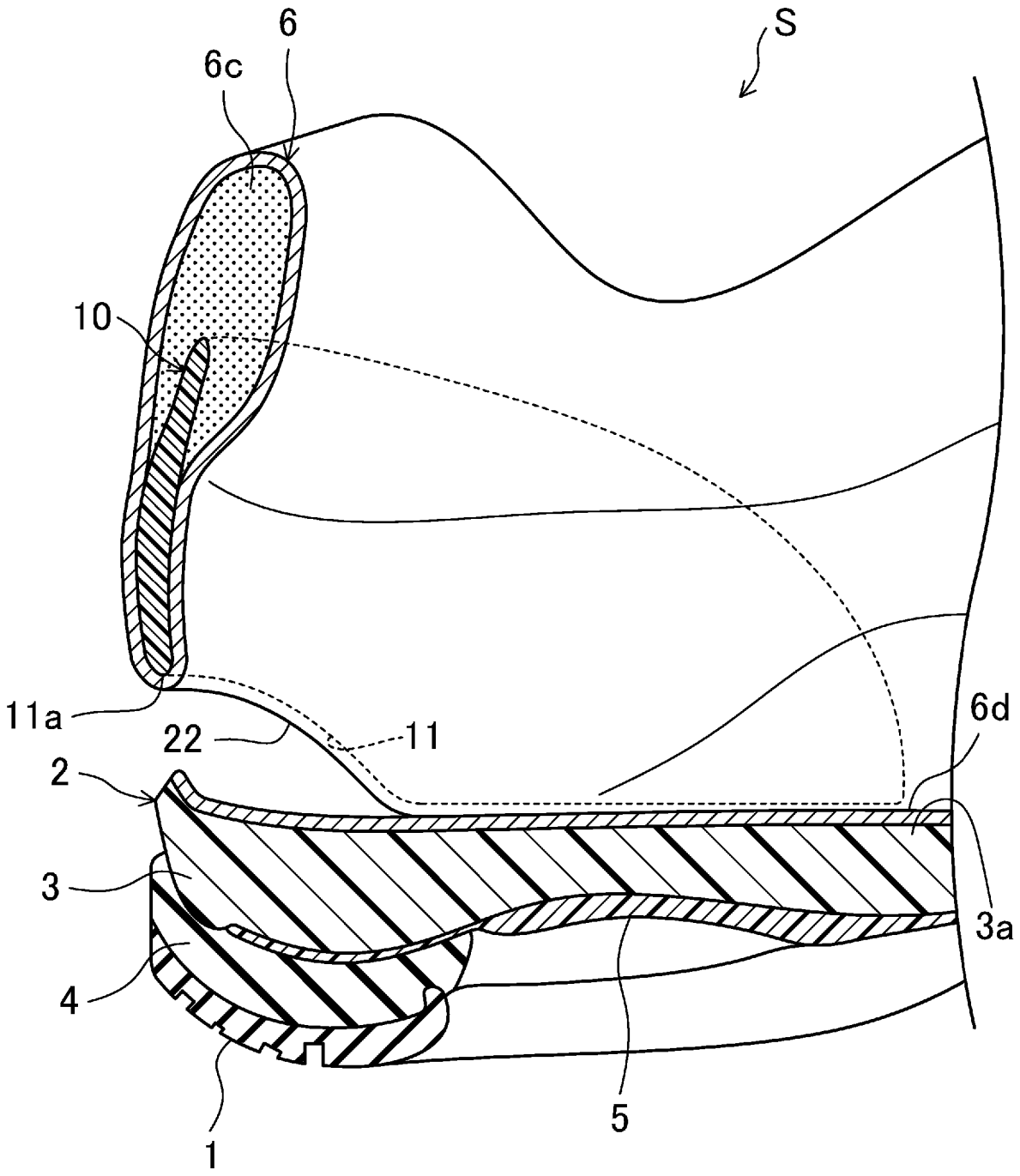
FIG. 10 corresponds to FIG. 8, and shows a shoe according to a second variation.

FIG. 10 shows a second variation of the shoe S according to the embodiment described above. As shown, the shoe S may include an upper's notch 22 in a rear portion of the upper 6. The upper's notch 22 is formed by partially cutting out a portion of the upper 6 corresponding to the deformation allowance portion. This upper's notch 22 substantially prevents wrinkles in the rear portion of the upper 6 at the moment of touching the ground and contributes to the prevention of deterioration of the aesthetic quality of the shoe S.

Third Variation of Embodiment

Figure 11:
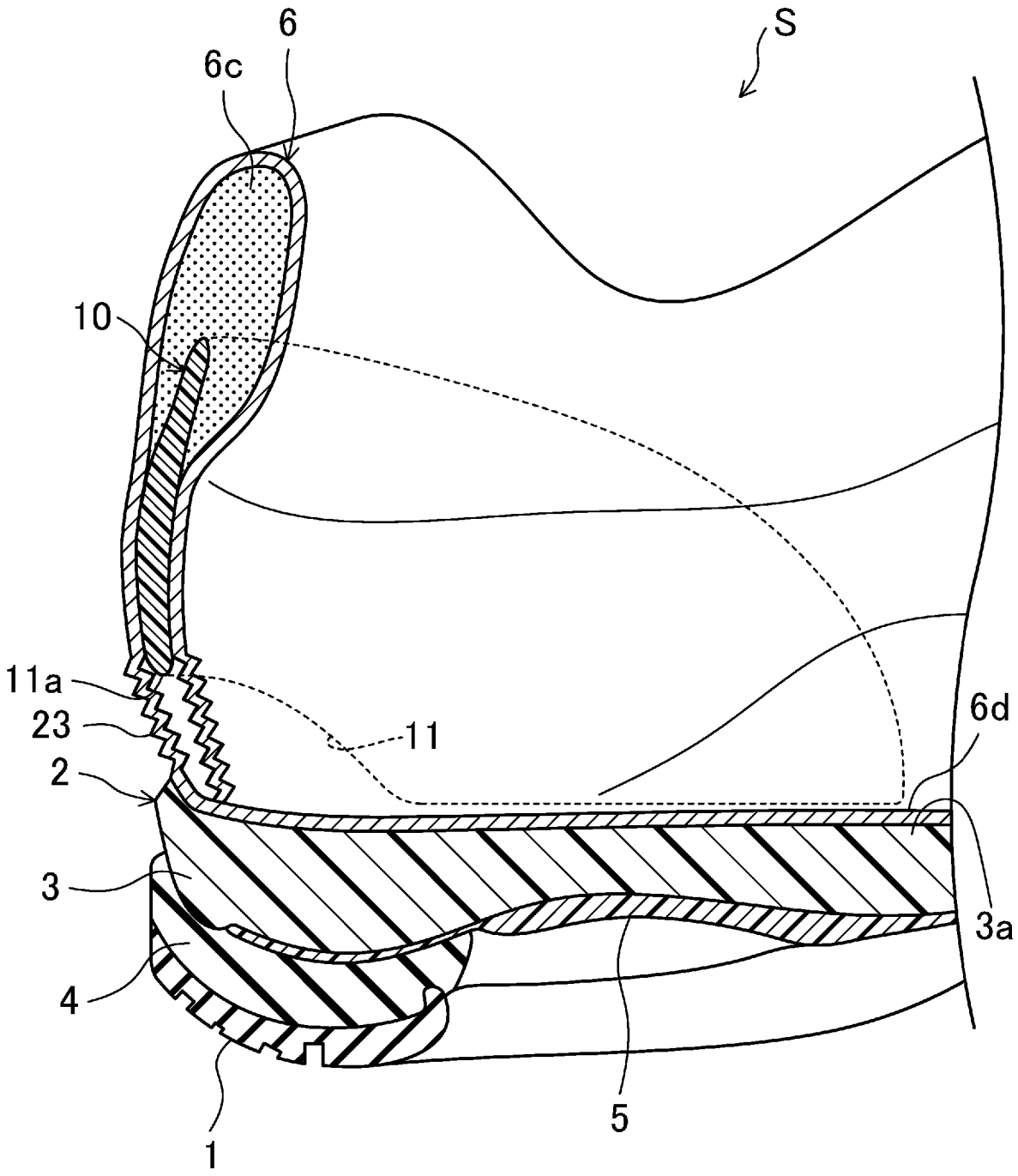
FIG. 11 corresponds to FIG. 8, and shows a shoe according to a third variation.

FIG. 11 shows a third variation of the shoe S according to the embodiment described above. As shown, the upper 6 may have a pleated portion 23 which is formed in a portion corresponding to the deformation allowance portion and stretchable in the vertical direction. In this variation, wrinkles which are easily formed in the rear portion of the upper 6 at the moment of touching the ground are assimilated into the shape of the pleated portion 23, thereby substantially preventing the aesthetic quality of the shoe S from being deteriorated.

Other Embodiments

Figure 12:
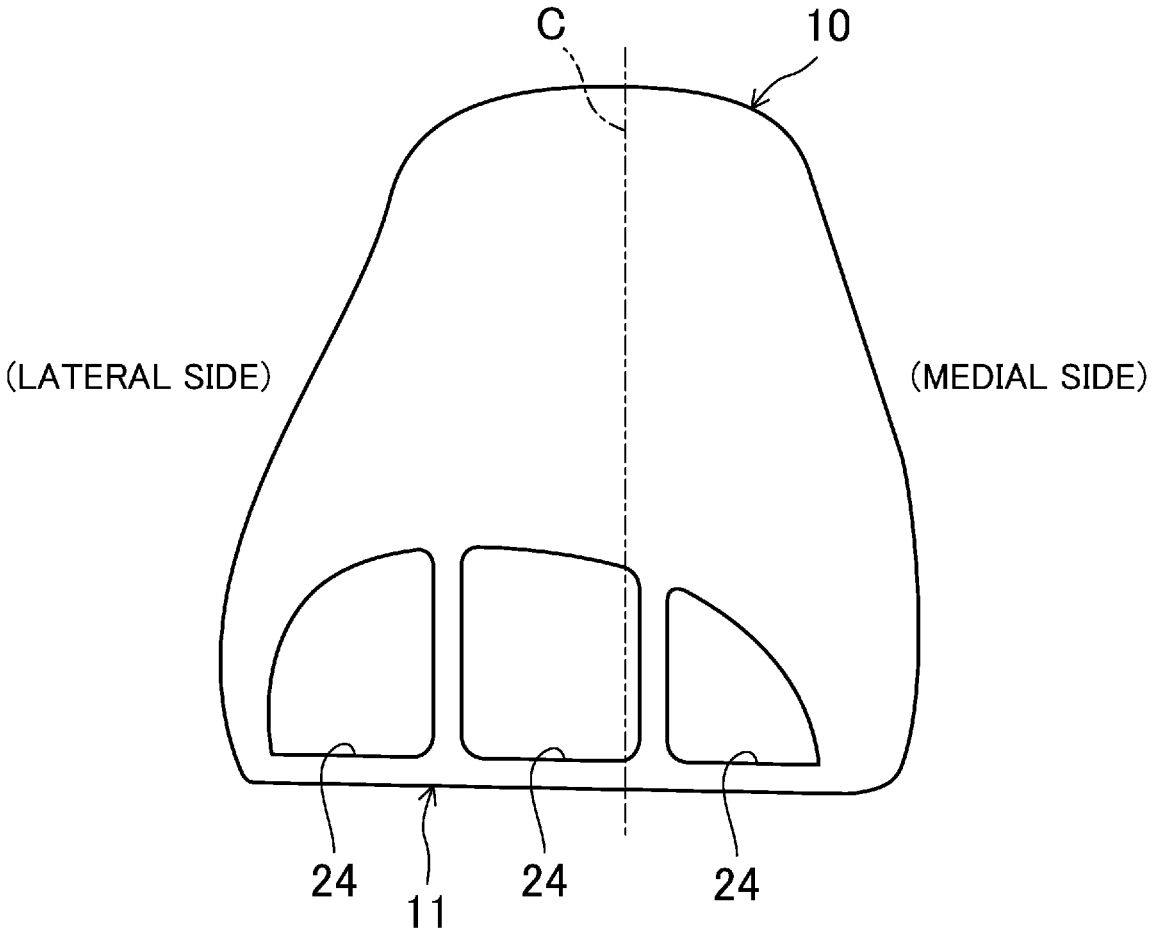
FIG. 12 corresponds to FIG. 5, and shows a heel counter according to another embodiment.

For the shoe S of the embodiment described above, the deformation allowance portion that is comprised of the notch 11 formed as an upwardly concave recess in the lower rear portion of the heel counter 10 has been described. However, this is merely a non-limiting example. For example, the deformation allowance portion may be made of a material which is more deformable than the heel counter 10. In a shoe S including the heel counter 10 having this deformable deformation allowance portion, the deformation allowance portion that is made of more deformable material than the heel counter 10 can softly protect a lower rear portion of the heel area H, enhance the cushioning properties of the sole, and give the wearer a sense of stability when he/she steps on the ground, just like the notch 11 of the embodiment described above. Further, the deformation allowance portion is not limited to the material more deformable than the heel counter 10. For example, as shown in FIG. 12, the deformation allowance portion may be comprised of a plurality of small openings 24, 24, . . . which are arranged at intervals in the foot width direction. This configuration also can enhance the cushioning properties of the sole and give the wearer a sense of stability when he/she steps on the ground. Each small opening 24 may be configured as a notch of which the bottom end is open (not shown).

Further, for the shoe S of the embodiment described above, the deformation allowance portion is formed such that its area adjacent to the lateral side is larger than its area adjacent to the medial side. However, this is merely a non-limiting example. The deformation allowance portion may be formed such that its area adjacent to the medial side is larger than its area adjacent to the lateral side. This configuration is suitable for indoor sports such as volleyball, for example. Specifically, the thus-configured deformation allowance portion can reduce impact which is predominantly applied to a medial side region of the foot when the wearer performs sidesteps to move left and right during a game. As a result, the wearer is allowed to step the floor with the medial side of his/her foot in a stable manner. That is to say, forming the deformation allowance portion such that its area adjacent to the lateral side and its area adjacent to the medial side are asymmetric in size to each other makes it possible to preferentially reduce impact applied predominantly to one of a lateral side region of the heel or a medial side region of the heel when the wearer steps on the ground or a floor, according to the styles of various sports games.

Note that the present disclosure is not limited to the embodiment described above, and various changes and modifications may be made without departing from the scope of the present disclosure.

EXAMPLES

The following samples were tested to overserve: a reaction force (hereinafter referred to as the "floor reaction force") in the vertical direction which a foot of a wearer received when the wearer stepped on a floor (ground); and behavior with respect to a shoe angle which will be described later.

In the measurement, "Standard Force Plate for Research and Sports, type 9281E" (manufactured by Kistler) was used as the floor reaction force measurer. Further, "Mac 3D System" (manufactured by Motion Analysis Corporation) was used as the three-dimensional motion measurer. The Mac 3D System includes a camera called "Eagle camera."

Shoes of sample 1 according to a comparative example, and shoes of samples 2 and 3 according to examples were subjected to the measurement. Each of the samples 1 to 3 includes a heel counter made of ethylene-vinyl acetate copolymer (EVA) as described in the above embodiment. The heel counter of the each of the samples 1 to 3 had, in its rear portion, a height (from the bottom end to the top end) of 53 mm, and a peripheral length (see the length L in FIG. 7) of 180 mm at the bottom edge.

The heel counter of the sample 1 did not have the notch corresponding to the deformation allowance portion described in the above embodiment. On the other hand, the heel counter of each of the samples 2 and 3 had the notch described in the above embodiment. Specifically, the notch of the sample 2 was formed such that a height from a rear bottom end of the heel counter to a top end of the notch (see the height h in FIG. 7) was 15 mm, and the length from one bottom end to the other bottom end (see the length w in FIG. 7) was 60 mm. The notch of the sample 3 was formed such that the height from a rear bottom end of the heel counter to a top end of the notch was 30 mm, and the length from one bottom end to the other bottom end was 100 mm.

The measurement was conducted on the assumption of a badminton match. A test subject (a skilled badminton player) weighing about 50 kg wore the shoes of each of the samples and returned a shuttlecock falling in front of the test subject. The state in which the shoe touched the floor was observed for each sample. Specifically, when the test subject moves to return the shuttlecock by going only one step forward with one foot (the right foot) and stepped on the floor with the heel of the right foot, the floor reaction force (N) acting on the heel contacting the floor was measured using the floor reaction force measurer and a shoe angle of the foot was measured using the three-dimensional motion measurer. This measurement was conducted three times for each sample. The average values of the measured values of the samples are respectively shown in FIGS. 13 to 15.

Figure 13:
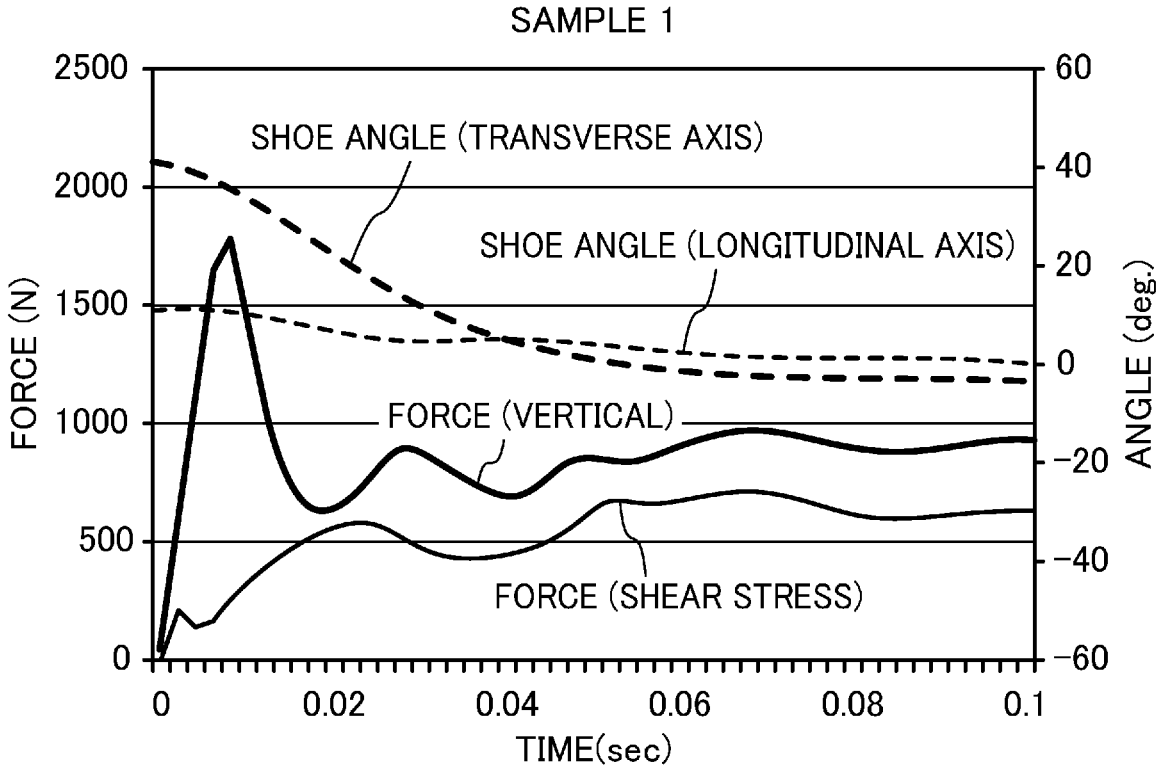
FIG. 13 is a graph showing results of measurement of a floor reaction force and a shoe angle of a shoe of Sample 1 (comparative example) over time after a moment of touching the ground.
Figure 14:
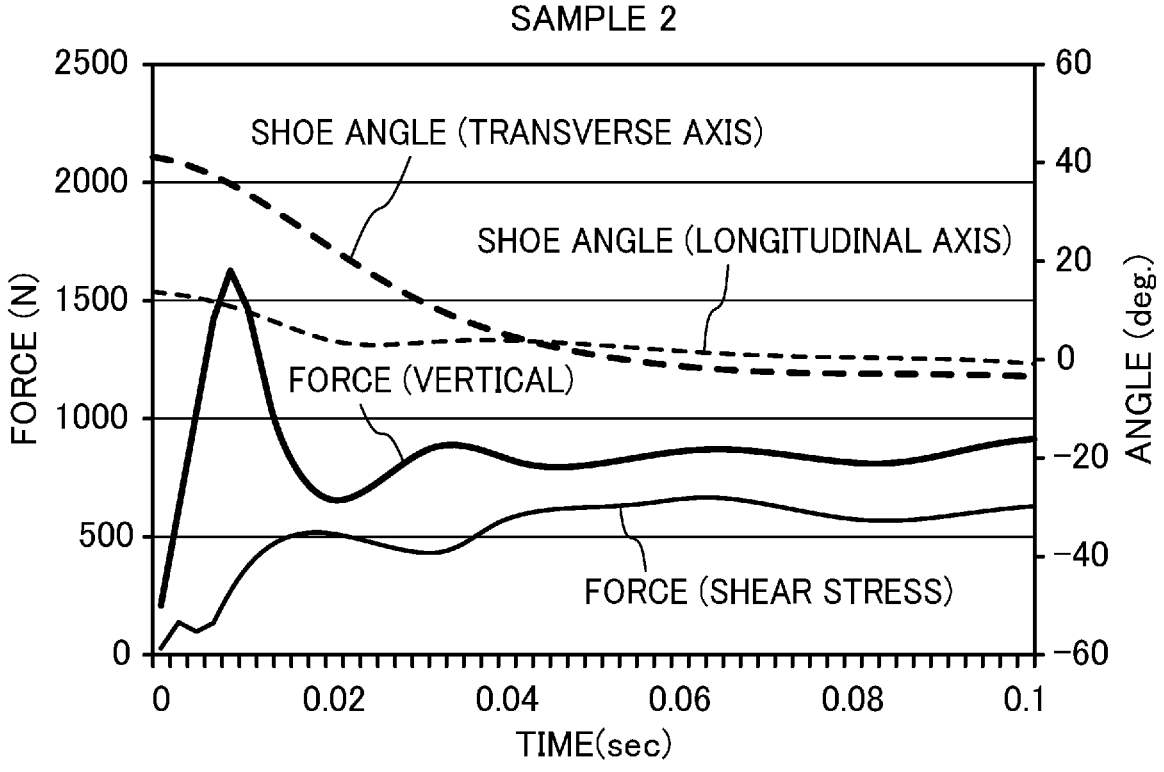
FIG. 14 corresponds to FIG. 13, and shows the result of measurement of a shoe of Sample 2 (an example).
Figure 15:
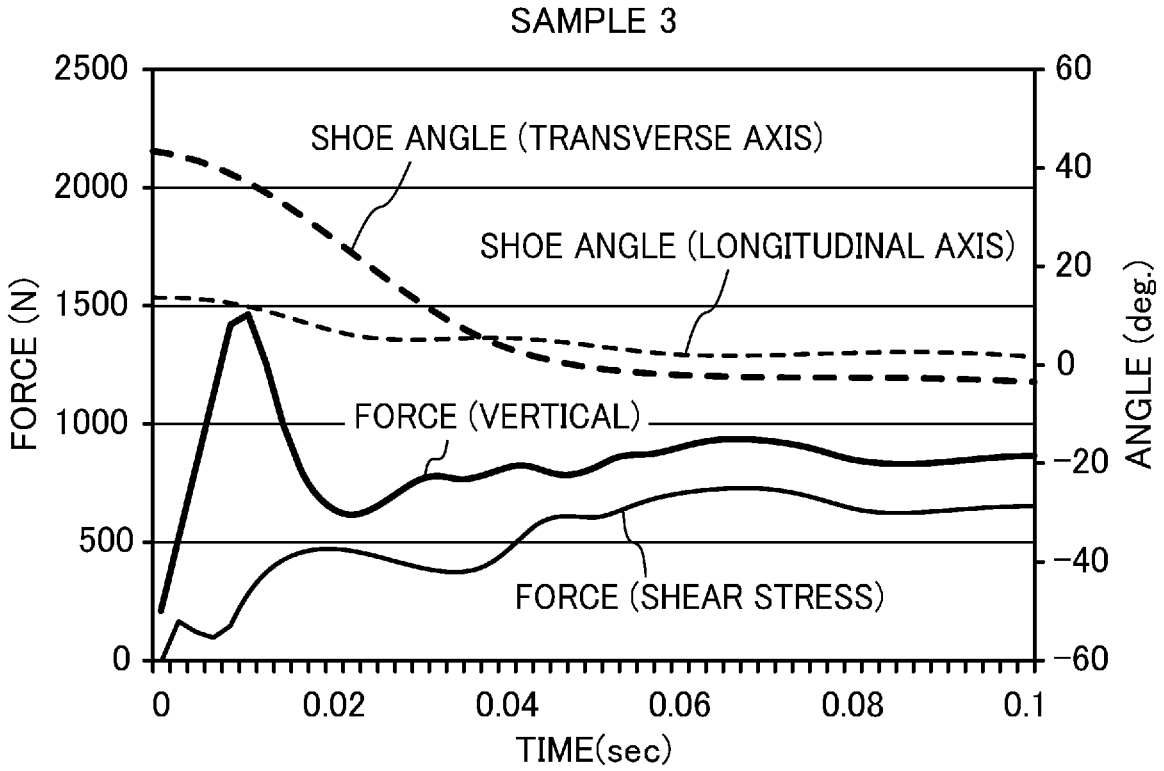
FIG. 15 corresponds to FIG. 13, and shows the result of measurement of a shoe of Sample 3 (another example).

In FIGS. 13 to 15, the shoe angle (deg.) represented by the right vertical axis is an angle of inclination of the shoe in plan view observed when the test subject stepped on the floor. Specifically, a state in which the shoe (the foot of the test subject) is oriented directly opposite to the body of the test subject was determined as being at 0 deg. A situation in which the shoe was oriented in a direction inclined clockwise from 0 deg. in plan view was defined as an orientation in a plus direction. A situation in which the shoe was oriented in a direction inclined counter-clockwise from 0 deg. in plan view was defined as an orientation in a minus direction. As shown in FIGS. 13 to 15, the shoe angle of the horizontal axis of the shoe of each example at the moment of touching the ground was about 40 deg. This means that when the test subject stepped on the floor, the lateral side of the foot of the test subject first came in contact with the floor.

As shown in FIG. 13, for the shoe of the sample 1, the time (hereinafter referred to as the "peak time") from the moment at which the foot of the test subject touched the floor to the moment at which the maximum floor reaction force acting on the shoe (hereinafter referred to as the "maximum floor reaction force") was generated was 0.008 sec, and the maximum floor reaction force was 1,788 N. As shown in FIG. 14, for the shoe of the sample 2, the peak time was 0.008 sec, and the maximum floor reaction force was 1,637 N. As shown in FIG. 15, for the shoe of the sample 3, the peak time was 0.010 sec, and the maximum floor reaction force was 1,478 N.

It has been noted that the maximum floor reaction force of the sample 2 is smaller by 8.5% than that of the sample 1. It has also been noted that the maximum floor reaction force of the sample 3 is smaller by as much as 17.3% than that of the sample 1. That is to say, it has been confirmed that the maximum floor reaction force of a shoe including a heel counter having a notch is less than that of a shoe including a heel counter having no notch. It has also been confirmed that an increase in the height from the rear bottom end of the heel counter to the top end of the notch results in further reduction of the maximum floor reaction force.

Thus, it has been verified that a shoe including a heel counter having a notch (deformation allowance portion) is capable of enhancing the cushioning properties of a sole and giving a wearer a sense of stability when he/she steps on the ground.

The present disclosure is industrially applicable to, for example, athletic shoes for running and various sports such as badminton, sneakers for daily use, and rehabilitation shoes.

What is claimed is:

1. A shoe comprising:

a sole made of an elastic material and including a planta support configured to support a plantar surface of a foot of a wearer;

an upper attached to the sole and configured to cover the foot of the wearer; and a heel counter provided above the planta support, arranged in a heel area of the upper corresponding to a heel of the foot, and extending from a medial side portion to a lateral side portion of the foot so as to cover the heel, wherein the heel counter includes, in a lower rear portion of the heel area, a deformation allowance portion which is configured to allow impact deformation caused by upward movement of a rear portion of the planta support when the sole receives impact, and the deformation allowance portion comprises a notch that is notched at an edge near the sole, the notch being formed in a lower rear portion of the heel counter and having a shape of a recess which is concave upward, the lower rear portion of the heel counter being open upward.

2. The shoe of claim 1, wherein the notch has a top end located between a position corresponding to a lower end of a calcaneus of the foot and a position corresponding to a top end of a calcaneal tuber.

3. The shoe of claim 1, wherein the deformation allowance portion is shaped such that an area of the deformation allowance portion adjacent to the lateral side is asymmetric in size to an area of the deformation allowance portion adjacent to the medial side.

4. The shoe of claim 3, wherein the deformation allowance portion is shaped such that the area adjacent to the lateral side is larger than the area adjacent to the medial side.

5. The shoe of claim 1, wherein the sole includes an upper midsole and a lower midsole stacked below the upper midsole, a reinforcing plate is disposed between the upper midsole and the lower midsole at a position corresponding to a hindfoot of the foot, and the reinforcing plate is comprised of a thin layer harder than the upper midsole and the lower midsole.

6. The shoe of claim 1, wherein the sole includes an outer cover portion which externally covers a rear portion of the upper, and the outer cover portion has a top end located above a top end of the notch.

7. The shoe of claim 1, wherein the heel counter is covered with the upper.

* * * * *